United States Patent [19]

Mentzel et al.

[11] 4,237,179

[45] Dec. 2, 1980

[54] PROCESS FOR FIREPROOFING CELLULOSE-CONTAINING FIBER MATERIAL DYED WITH COPPER-COMPLEX AZO DYES

[75] Inventors: Detlef Mentzel, Wehr, Fed. Rep. of Germany; Hans-Rudolf Frei, Basel, Switzerland

[73] Assignee: Ciba-Geigy Corporation, Ardsley, N.Y.

[21] Appl. No.: 824,478

[22] Filed: Aug. 15, 1977

[30] Foreign Application Priority Data

Aug. 27, 1976 [CH] Switzerland ..... 10885/76

[51] Int. Cl.[2] ..... D06P 1/10; D06P 5/06; D06P 5/08; C09D 5/18

[52] U.S. Cl. ..... 428/276; 8/490 8/42 R; 8/73; 106/18.15; 106/18.18; 106/18.19; 252/8.1; 427/393.3; 427/394; 428/289; 428/290; 428/526; 428/921

[58] Field of Search ..... 8/17, 52, 73, 171, 42 R, 8/18 R; 428/276, 289, 290, 526, 921; 427/390 D, 394; 106/15 FP, 18.15, 18.18, 18.19; 252/8.1

[56] References Cited

U.S. PATENT DOCUMENTS

| | | | |
|---|---|---|---|
| 2,467,160 | 4/1949 | Scott | 260/71 X |
| 2,991,143 | 7/1961 | Rosenlind | 8/30 X |
| 3,644,083 | 2/1972 | Stockel et al. | 428/276 X |
| 3,829,287 | 8/1974 | Litke | 8/42 R |
| 4,076,650 | 2/1978 | McDonald | 252/8.1 |

FOREIGN PATENT DOCUMENTS

| | | | |
|---|---|---|---|
| 566171 | 11/1958 | Canada | 427/390 D |
| 1139380 | 1/1969 | United Kingdom | 427/390 D |

*Primary Examiner*—Michael R. Lusignan
*Attorney, Agent, or Firm*—Prabodh I. Almaula

[57] ABSTRACT

A process is provided for flameproofing cellulose containing fiber material which is dyed with copper-complex azo dyes. In this process the fiber material is heated with an aqueous composition containing (a) a dialkylated phosphono-propionic acid amide or its N-methylolated derivate (b) an alkanolamine such as a 2-amino-2-alkyl-1-alkanol (c) a water-soluble copper salt such as copper (II) chloride or sulphate (d) optionally an aminoplast precondensate or an etherified aminoplast pre-condensate such as methylolated or melamines or their alkyl ethers.

The treated fiber material is dryed (e.g. up to 120° C.) and then subjected to a heat treatment at e.g. 140° to 200° C.

13 Claims, No Drawings

PROCESS FOR FIREPROOFING CELLULOSE-CONTAINING FIBER MATERIAL DYED WITH COPPER-COMPLEX AZO DYES

The invention relates to a process for fireproofing cellulose-containing fibre material dyed with copper-complex azo dyes or with azo dyes treatable with copper or after-coppered, which process comprises applying to the fibre material an aqueous preparation containing at least (a) one phosphorus compound of the formula

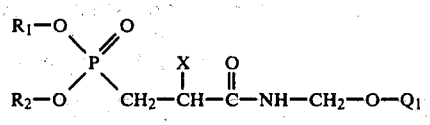

(1)

wherein $Q_1$ is hydrogen, alkyl or alkenyl having at most 4 carbon atoms, $R_1$ and $R_2$ are each alkyl, halogenoalkyl or alkenyl each having at most 4 carbon atoms, and X is hydrogen or methyl, (b) one alkanolamine of the formula

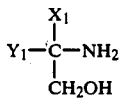

(2)

wherein $X_1$ is alkyl, hydroxyalkyl or halogenoalkyl each having 1 to 4 carbon atoms, or hydrogen, and $Y_1$ is alkyl, hydroxyalkyl or halogenalkyl each having 1 to 4 carbon atoms, phenyl, benzyl or cyclohexyl, with the alkanolamine being in the form of a water-soluble acid addition salt of inorganic acids, of aliphatic mono- or dicarboxylic acids having at most 4 carbon atoms, or of aromatic mono- or dicarboxylic acids having at most 9 carbon atoms, (c) one water-soluble copper salt of an inorganic acid or of an alkanecarboxylic acid having 1 to 3 carbon atoms, and (d) optionally one aminoplast pre-condensate or one etherified aminoplast pre-condensate;

and thereupon drying the treated fibre material and subjecting it to a heat treatment.

Suitable as component (a), which is contained in the aqueous preparations, are in particular phosphorus compounds of the formula

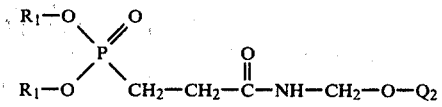

(1.1)

wherein $Q_2$ is allyl, ethyl, preferably methyl or hydrogen, and $R_1$ has the given meaning.

Other preferred phosphorus compounds correspond to the formula

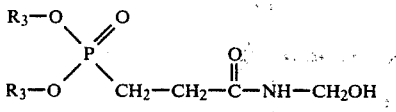

(1.2)

wherein $R_3$ is alkyl having 1 to 3 carbon atoms, and especially ethyl or methyl.

As the most preferred specific representative of the phosphorus compounds, there may be mentioned the phosphorus compound of the formula

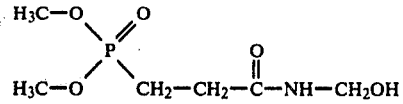

(1.3).

The phosphorus compounds used in the process according to invention are known per se, and are described, for example, in the British Patent Specification No. 1,139,380.

The aqueous preparation for performing the process according to the invention contains as component (b) preferably an alkanolamine of the formula

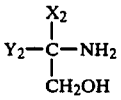

(2.1)

wherein $X_2$ is methyl, ethyl, propyl, hydroxyethyl or hydrogen, and $Y_2$ is methyl, ethyl, propyl, hydroxyethyl or phenyl; and the alkanolamine is in the form of an addition salt of hydrochloric, phosphoric, sulphuric, boric, sulphamic, acetic, chloroacetic, propionic, butyric, acrylic, maleic, benzoic, cinnamic or phthalic acid.

Also preferred is 2-amino-2-methyl-1-butanol, 2-amino-2-ethyl-1-butanol or 2-amino-2-methyl-1-propanol, which are in the form of addition salts of hydrochloric, phosphoric or sulphuric acid. Most of all preferred are hydrochloric acid, phosphoric acid and sulphuric acid salts of 2-amino-2-methyl-1-propanol. The alkanolamines used according to the invention as component (b) of the aqueous preparation are known per se; and are described, for example, in the U.S. Pat. No. 2,467,160.

As water-soluble copper salts of an alkanecarboxylic acid having 1 to 3 carbon atoms, which are contained as component (c) in the aqueous preparation for performing the process according to the invention, there may be mentioned the double salts of copper(II) oxalate with alkali oxalates, and particularly copper(II) acetate. The copper salts of an inorganic acid are however preferred to the copper salts of an alkanecarboxylic acid. Especially suitable in this respect is copper(II) nitrate, copper(II) chloride or copper(II) sulphate. Primarily of interest with regard to the use of inorganic copper salts is the use of copper(II) chloride and, in particular, of copper(II) sulphate. These inorganic copper(II) salts can be used also as a commercial mixture with a dicyanodiamide/amine/formaldehyde condensate or with an alkylenediamine/formaldehyde condensate.

By aminoplast pre-condensates, which can be used as optional component (d) of the aqueous preparation in the process according to the invention, are meant in the present case addition products of formaldehyde with nitrogen compounds that can be methylolated. The following may be mentioned as optionally concomitantly used nitrogen compounds that can be methylolated: 1,3,5-aminotriazines such as N-substituted melamines, e.g. N-butylmelamine, N-trihalogenomethylmelamines, triazones and also guanamines, e.g. benzoguanamines, acetoguanamines or diguanamines.

Further compounds which can be used are: cyanamide, acrylamide, alkyl- or arylureas and alkyl- or arylthioureas, alkyleneureas or alkylenediureas, e.g. urea, thiourea, urons, ethyleneurea, propyleneurea, acetylenediurea or 4,5-dihydroxyimidazolidone-2 and derivatives thereof, e.g. the 4,5-dihydroxyimidazolidone-2 substituted in the 4-position on the hydroxyl group with the radical $—CH_2CH_2—CO—NH—CH_2OH$, carbamates of lower alkanols, such as methyl carbamate, ethyl carbamate or hydroxyethyl carbamate. Compounds which can be used are preferably the methylol compounds of urea, of an ethyleneurea or, in particular, of melamine. Valuable products can in general be products methylolated to the highest possible degree, but particularly also lower methylolated products, e.g. etherified or unetherified methylolureas or methylolmelamines, or corresponding ethers thereof. Products which can be suitable as aminoplast pre-condensates are both predominantly monomolecular aminoplasts, such as di- or trimethylolmelamine, and more highly precondensed aminoplasts, such as dimethylolurea pre-condensates. Preferably, the ethers of these aminoplast pre-condensates are used. For example, the ethers of alkanols such as ethanol, n-propanol, isopropanol, n-butanol or, in particular, methanol can be advantageously used.

Accordingly, there are preferably used as component (d) in the process of the invention N-methylolureas or N-methylolmelamines, which are optionally etherified with an alkanol having 1 to 4 carbon atoms. Most preferred in this case are water-soluble methylolmelamine methyl ethers, especially pentamethylolmelamine dimethyl ether and pentamethylolmelamine trimethyl ether.

The aqueous preparation which is used to perform the process according to the invention, which preparation constitutes a further subject of the present invention, contains per liter 250 to 450 g, preferably 250 to 350 g, particularly 300 to 340 g, of the component (a); 10 to 20 g, preferably 11 to 15 g, of the component (b); 1 to 6 g, preferably 2 to 4 g, of the component (c); and 0 to 60 g, preferably 40 to 60 g, especially 45 to 50 g, of the component (d).

If no component (d) is present, it is advantageous to increase the amount of component (a), for example by about 20%. Thus, preparations containing no aminoplast pre-condensate preferably contain per liter up to 450 g of the component (a).

In addition to the components (a) to (d), the aqueous preparation can contain as a further, in some cases advantageous, additive a finishing agent imparting softness, for example an aqueous polysiloxane emulsion or polyethylene emulsion or ethylene copolymer emulsion, or preferably agents imparting a soft handle, such as are described in the U.S. Pat. No. 3,956,243, or in particular highly etherified melamine/formaldehyde condensation products modified with fatty acid alkanolamides.

Also an addition of wetting agents, e.g. of condensation products from alkylated phenols with ethylene oxide, can be advantageous.

The amounts of agents imparting a soft handle and/or wetting agents of the given type optionally added is advantageously 2 to 20 g, preferably 3 to 10 g, per liter of the aqueous preparation.

The pH of the aqueous preparation is as a rule 5.0 to 7.5 and particularly 6.0 to 7.0. If necessary, the pH of the preparations can be brought to the preferred value of 6.0 to 7.0 with inorganic acids, e.g., hydrochloric acid, sulphuric acid or preferably phosphoric acid; or with inorganic bases, e.g. with an aqueous potassium hydroxide solution or, in particular, sodium hydroxide solution.

An addition of buffer substances, e.g. sodium bicarbonate, di- and trisodium phosphate or triethanolamine, can also be advantageous.

The amount of addition, which is optionally used to adjust the pH value to 6.0 to 7.0, is dependent on the value chosen and on the type of additive.

The process according to the invention is suitable in particular for flameproofing dyed, cellulose-containing fibre materials, such as cotton, linen, sisal and ramie. Also regenerated cellulose materials, such as artificial silk fibres and rayon fibres, can be thus treated. Of primary interest are however natural cellulose fibres, especially cotton fibres. The fibre materials concerned are particularly textiles at any stage of processing, such as yarns or finished garments; but preferably in piece form, such as fabrics, knitted articles and fleeces.

The copper-complex azo dyes or the azo dyes treatable with copper or after-coppered, with which the cellulose-containing fibre materials to be rendered fireproof by the process according to the invention are dyed, are direct dyes known per se, and are described, for example, in the British Patent Specifications Nos. 542,731, 575,423, 624,018, 651,917, 674,707, 736,166, 751,386, 756,599, 784,665 and 889,659; in the German Patent Specifications Nos. 474,997 and 746,455; and in the Swiss Patent Specifications Nos. 236,584, 241,824, 335,777 and 340,000.

Some specific representatives of these dyes are the dyes according to C.I. No. 19,555, 24,401, 29,120, 29,166, 29,225 and 74,180; the dyes according to Example 1 of the British Patent Specification No. 674,707, to Example 2 of the British Patent Specification No. 736,166, and to Example 2 of the British Patent Specification No. 751,386; and the dyes which correspond to the following formulae (3.1) to (3.17) [formula (3.13) and formula (3.15) are mixture components for copper-complex dyes or for azo dyes treatable with copper or after-coppered]:

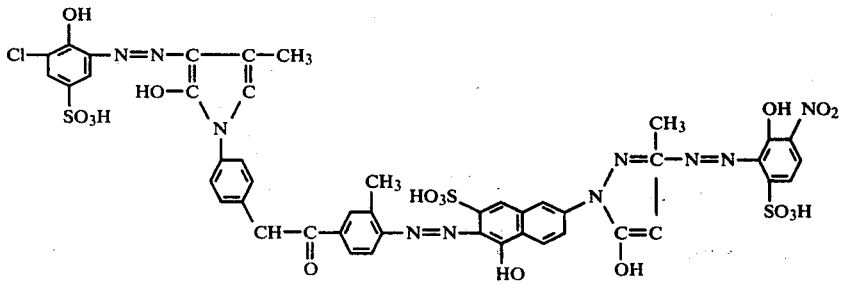

(3.1)

-continued
(3.2)
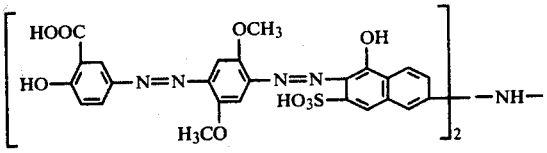
(3.3)
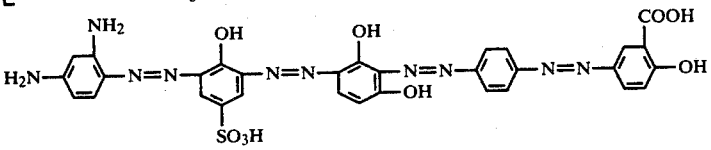
(3.4)
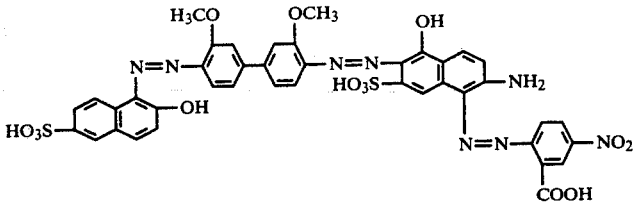
(3.5)
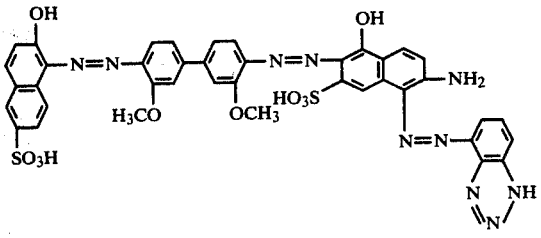
(3.6)
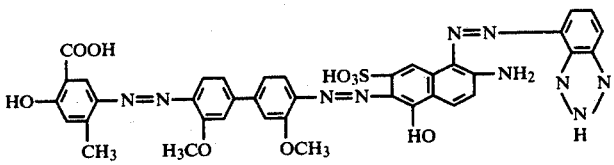
(3.7)
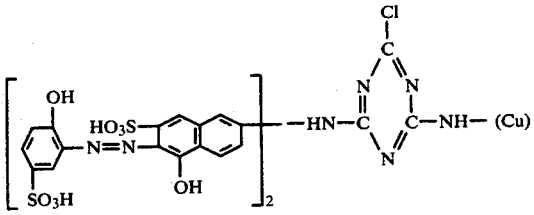
(3.8)
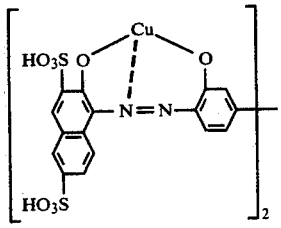
(3.9)
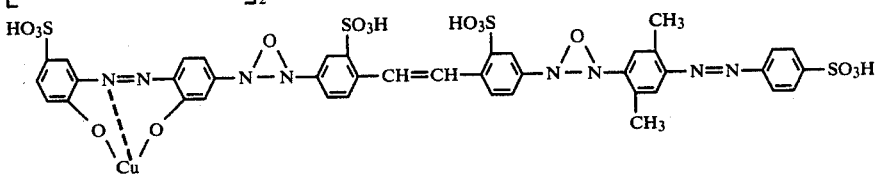
(3.10)
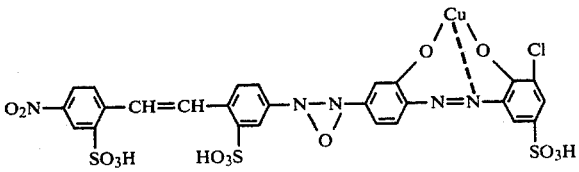

-continued (3.11)

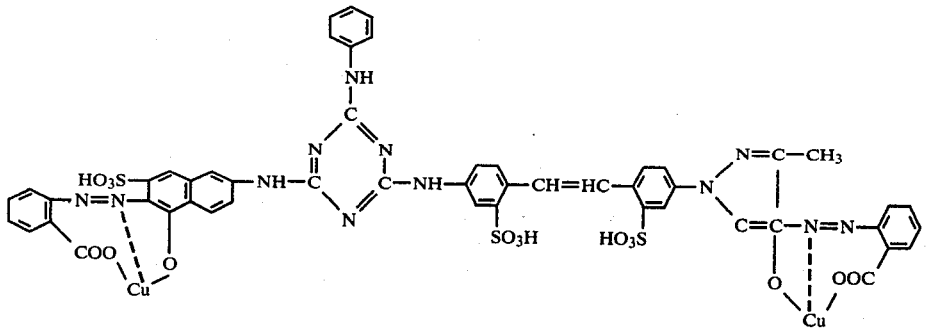

(3.12)

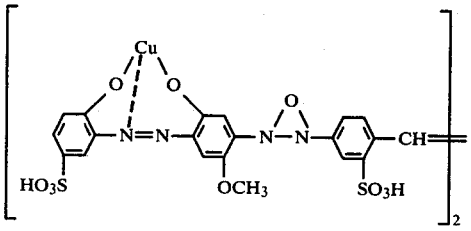

(3.13)

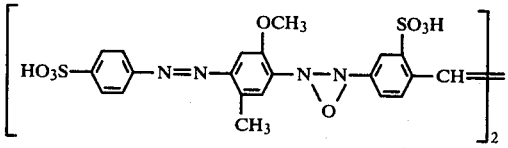

(3.14)

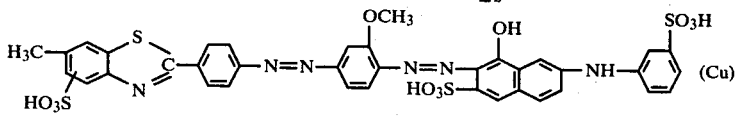

(3.15)

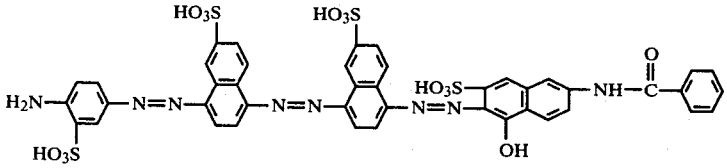

(3.16)

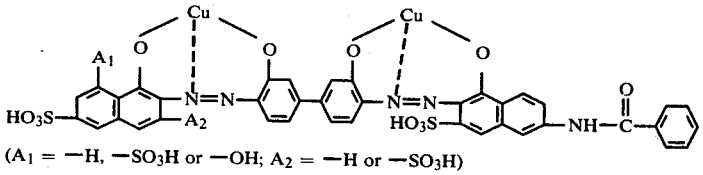

($A_1$ = —H, —$SO_3H$ or —OH; $A_2$ = —H or —$SO_3H$)

(3.17)

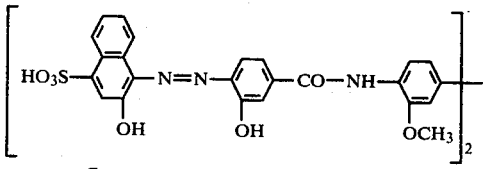

(3.18)

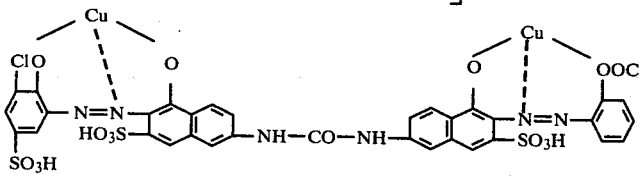

The aqueous preparations in the process according to the invention are applied in a manner known per se to the dyed, cellulose-containing fibre materials. Preferably, the materials to be treated are in the form of piece goods, and these are impregnated on a padding machine of conventional design, which is charged with the preparation at room temperature.

The fibre material impregnated in this manner has then to be dried, an operation advantageously performed at a temperature of up to 120° C. The material is subsequently subjected to a dry heat treatment at a temperature of above 120° C., preferably between 140° and 200° C., and particularly between 150° and 180° C.; and the higher the temperature is, the shorter can be the duration of the heat treatment. This heating time can be, for example, 2 to 6 minutes at temperatures of 180° to 150° C. Since in this operation the hydroxyalkyl radicals or the ether radicals of the components (a), (b) and (c) contained in the aqueous preparation, particularly the methylol or methylol ether radicals of the optionally etherified aminoplast pre-condensate advantageously concomitantly used, become condensed, water or an alcohol is formed. It has been shown that these volatile decomposition products have to be removed, advantageously continuously, from the material so that the desired action can occur to the full extent. This factor is to be taken into account in choosing the devices in which the heat treatment is carried out. Apparatus well suited for the purpose is that into which fresh air is continuously fed, whilst the prescribed temperature is maintained, and the air laden with the volatile substances forming is continuously removed. Such devices, e.g. those known as turbo-fixers or nozzle-fixers, are known.

There is subsequently carried out a washing treatment with an acid-binding agent, such as a sodium hydroxide solution or, in particular, an aqueous sodium carbonate solution, e.g. at 40° C. up to the boiling temperature, preferably at 60° C., for 3 to 10 minutes at pH 8. Only in this way is it possible to remove the last acid residues which otherwise cause, inter alia, within 24 hours a gradual hydrolysis of the applied finish, and hence impair the storage-stability thereof.

The fireproof finishes imparted to the dyed, cellulose-containing fibre materials by the process according to the in invention are largely retained even after repeated washing or dry cleaning. They result in no unacceptable impairment of the textile-mechanical properties, inter alia of the handle, the stiffness in flexure, the tensile strength, the resistance to abrasion and the crease angle, of the fibre material treated.

To be mentioned as an important advantage is the fact that the dyeing of the dyed, cellulose-containing fibre materials treated in the process according to the invention is retained virtually intact. In particular, the fastness to light and the colour fastness and the shade of the dyeings on the fibre materials fireproofed by the process according to the invention are excellent.

Percentages in the following Examples are percent by weight.

EXAMPLE 1

Mercerised and bleached cotton gabardine is dyed with the dyes listed in the following Table 1. The dyed fabric specimens are then padded according to the invention with the following aqueous liquor A:

Liquor A 400 g of the phosphorus compound of the formula (1.3) (80%) per liter,
35 g of 2-amino-2-methyl-1-propanol hydrochloride (37%) per liter,
5 g of $CuSO_4.5H_2O$ per liter,
80 g of pentamethylolmelamine di- and -trimethyl ether (60%) per liter,
20 g of a fatty-acid-modified melamine/formaldehyde reaction product (30%) per liter.

The liquor absorption is 80%.

The padded fabric specimens are dried at 100° C. and thermofixed at 160° C. for 4½ minutes. They are afterwards washed in a 3% aqueous sodium carbonate solution at 60° C. All the treated fabric specimens are fireproof in the vertical test according to DIN 53,906, i.e. they give burning times of 0 seconds and tear lengths of 10 to 12 cm, this being so even after repeated service washings at 95° C. for 60 minutes each time in solutions containing per liter 5 g of commercial detergent according to SNV 198,861. On the other hand, an untreated fabric specimen burns completely away. Furthermore, the fabric specimens to which a fireproof finish has been imparted have a pleasant soft handle.

In addition to fireproofness, there are also determined the fastness to light of the dyeings on the fabric specimens in xenon light according to SNV 195,809 and the colour fastness of the dyeings using the grey scale for the evaluation of the change of colour according to SNV 195,805. According to SNV 195,809, the fastness to light is expressed in ratings, with 8 being the best and 1 the poorest rating. According to SNV 195,805, the colour fastness is likewise expressed in ratings, with 5 being the best and 1 the poorest rating. Moreover, for indicating the change of shade of the colour, the following abbreviations are if necessary employed:

B=bluer,
G=yellower or greener,
R=redder,
H=weaker, paler,
D=stronger, darker,
T=duller, flatter,
F=finer, clearer.

The results of the tests for fastness to light and colour fastness are summarised in the following Table 1. The colour fastness of the untreated fabric specimens corresponds to the rating 5.

TABLE 1

| Dye with which the fabric specimens are dyed | Fireproofed fabrics: Fastness to light (ratings according to SNV 195,809) | Fireproofed fabrics: Colour fastness (ratings according to SNV 195,805) | Fabrics not fireproofed: Fastness to light (ratings according to SNV 195,809) |
|---|---|---|---|
| according to formula (3.1) | 6 | 4–5 | 5–6 |
| according to formula (3.2) | 6 | 4–5 | 5–6 |
| according to formula (3.3) | 5 | 3–4 H | 5–6 |
| according to formula (3.4) | 7 | 4 | 6–7 |
| according to formula (3.5) | 7 | 4–5 | 6–7 |
| according to formula (3.7) | 7–8 | 4–5 | 6–7 |
| according to formula (3.8) | 6 | 4 | 5–6 |
| according to formula (3.9) | 7 | 3 GR | 5–6 |
| | 7 | 3 R | 6 |
| according to formula (3.10) | 7 | 4 | 6 |
| according to formula (3.11) | 7–8 | 3–4 G | 6 |
| according to formula (3.14) | 7–8 | 3 G | 6–7 |

TABLE 1-continued

| Dye with which the fabric specimens are dyed | Fireproofed fabrics: Fastness to light (ratings according to SNV 195,809) | Fireproofed fabrics: Colour fastness (ratings according to SNV 195,805) | Fabrics not fireproofed: Fastness to light (ratings according to SNV 195,809) |
|---|---|---|---|
| mixture of 70% of the dye according to formula (3.16), wherein $A_1$ is $-SO_3H$ and $A_2$ is $-H$, and 30% of the dye according to formula (3.16) wherein $A_1$ is $-H$ and $A_2$ is $-SO_3H$ | 7–8 | 2–3 RF | 7–8 |
| according to formula (3.16) wherein $A_1$ is $-OH$ and $A_2$ is $-SO_3H$ | 7 | 3 RF | 7 |
| according to C.I. No. 24,401 | 5 | 4–5 | 5 |
| according to C.I. No. 29,120 | 6 | 2 R | 5–6 |
| according to C.I. No. 29,166 | 6–7 | 4 | 6 |
| according to C.I. No. 74,180 | 5 | 4–5 | 5–6 |
| according to Example 1 of the British Patent Specification No. 674,707 | 6 | 2–3 R | 6 |
| according to Example 2 of the British Patent Specification No. 751,386 | 5 | 4 | 6 |
| mixture of dyes according to formula (3.6) and to Example 2 of the British Patent Spec. No. 736,166 | 6–7 | 4–5 | 6–7 |
| mixture of dyes according to formulae (3.9), (3.12), (3.13) and C.I. No. 19,555 | 6–7<br>7<br>6 | 3 R<br>2–3 R<br>2–3 G | 5–6<br>5–6<br>5–6 |
| mixture of dyes according to formulae (3.12), (3.15) and C.I. No. 29,225 | 6–7 | 3–3 R | 6–7 |

EXAMPLE 2

Mercerised and bleached cotton gabardine and leached viscose spun rayon cretonne are dyed with the dyes listed in the following Tables 3 and 4. The dyed fabric specimens are then padded according to the invention with the aqueous liquors B to M of the compositions given in the following Table 2.

The liquor absorption is 80%.

The padded fabric specimens are dried at 100° C. and thermofixed at 160° C. for 5 minutes.

The fabric specimens are subsequently washed as described in Example 1 and tested for flameproofness according to DIN 53,906. As in Example 1, all the fabric specimens have a permanent fireproof finish and at the same time a soft handle.

The fabric specimens are also tested for fastness to light and colour fastness according to SNV 195,809 and 195,805, as given in Example 1, and the results of these tests are summarised in the following Table 3 for the cotton gabardine and in the subsequent Table 4 for the spun rayon/cretonne.

TABLE 2

| Liquor components | Content % | Liquor designation and concentration of the components in g/l: B | C | D | E | F | G | H | I | J | K | L | M |
|---|---|---|---|---|---|---|---|---|---|---|---|---|---|
| N-methylol-dimethyl-phosphono-propionic acid amide | 80 | 400 | 400 | 400 | 400 | 400 | 480 | 480 | — | — | — | — | — |
| N-methylol-diethyl-phosphono-propionic acid amide | 100 | — | — | — | — | — | — | — | 360 | 440 | 440 | — | — |
| methyl ether of N-methylol-dimethoxy-phosphono-propionic acid amide | 100 | — | — | — | — | — | — | — | — | — | — | 39 | 390 |
| 2-amino-2-methyl-1-propanol hydrochloride | 37 | 35 | 35 | 35 | — | — | 35 | 35 | — | 35 | — | 35 | 35 |
| 2-amino-2-methyl-1-propanol-sulphate | 46 | — | — | — | 30 | — | — | — | — | — | — | — | — |
| 2-amino-2-methyl-1-propanol-dihydrogen phosphate | 46 | — | — | — | — | 30 | — | — | 30 | — | 30 | — | — |
| $CuSO_4 . 5H_2O$ | 100 | — | 5 | — | 5 | 5 | 5 | — | — | — | — | — | — |
| mixture of an alkylene-diamine/formaldehyde condensate with $CuSO_4 . 5H_2O$, $CuCl_2 . 2H_2O$ and NaCl (Cu-salt content: 34%) | 100 | 15 | — | 15 | — | — | — | 15 | 15 | 15 | 15 | 15 | 15 |
| di- and -trimethylolme- | 75 | 80 | — | — | — | — | — | — | — | — | — | 80 | — |

TABLE 2-continued

| Liquor components | Content % | Liquor designation and concentration of the components in g/l | | | | | | | | | | | |
|---|---|---|---|---|---|---|---|---|---|---|---|---|---|
| | | B | C | D | E | F | G | H | I | J | K | L | M |
| lamine dimethylolurea pre-condensate | 100 | — | 50 | 50 | 50 | 50 | — | — | 50 | — | — | — | 50 |
| fatty-acid-modified melamine/formaldehyde reaction product | 30 | 20 | 20 | 20 | 20 | 20 | 20 | 20 | 20 | 20 | 20 | 20 | 20 |

TABLE 3

| Cotton fabrics | | | | |
|---|---|---|---|---|
| | | Fireproofed fabrics | | Fabrics which are not fireproofed |
| Dye with which the fabric specimens are dyed | liquor designation with which the fabric specimens are fireproofed | Fastness to light (ratings according to SNV 195,809) | Colour fastness (ratings according to SNV 195,805) | Fastness to light (ratings according to SNV 195,809) |
| formula (3.8) | B | 7 | 4–5 | 6–7 |
| formula (3.4) | C | 7 | 3–4 H | 5–6 |
| formula (3.4) | D | 7 | 3–4 H | 5–6 |
| formula (3.17) | D | 7 | 4–5 | 6–7 |
| formula (3.18) | E | 7 | 4 HF | 5–6 |
| formula (3.8) | F | 6–7 | 5 | 6–7 |
| formula (3.18) | G | 7 | 4 HF | 5–6 |
| formula (3.18) | H | 7 | 4 BF | 5–6 |
| formula (3.1) | I | 6 | 4–5 | 5–6 |
| formula (3.1) | J | 6 | 4–5 | 5–6 |
| formula (3.1) | K | 6 | 4–5 | 5–6 |
| formula (3.8) | L | 7 | 4–5 | 6–7 |
| formula (3.4) | M | 7 | 4 GH | 5–6 |
| formula (3.8) | M | 7 | 4–5 | 6–7 |

TABLE 4

| Viscose fabrics | | | | |
|---|---|---|---|---|
| | | Fireproofed fabrics | | Fabrics which are not fireproofed |
| Dye with which the fabric specimens are dyed | Liquor designation with which the fabrics are fireproofed | Fastness to light (ratings according to SNV 195,809) | Colour fastness (ratings according to SNV 195,805) | Fastness to light (ratings according to SNV 195,809) |
| formula (3.18) | B | 7 | 4 T | 7 |
| formula (3.18) | C | 7 | 3–4 F | 7 |
| formula (3.18) | D | 7 | 3–4 F | 7 |
| formula (3.18) | F | 7 | 3–4 F | 7 |
| formula (3.17) | I | 7 | 3–4 H | 7 |
| formula (3.18) | I | 7 | 3–4 F | 7 |

We claim:

1. Process for fireproofing cellulose containing textile fiber material dyed with copper-complex azo dyes or with azo dyes treatable with copper or after-coppered, which process comprises applying to the fiber material an aqueous preparation comprising (a) 250 to 450 g of a phosphorus compound of the formula

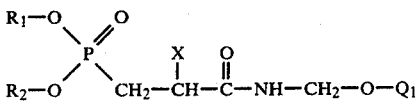

wherein $Q_1$ is hydrogen, alkyl or alkenyl having at most 4 carbon atoms, $R_1$ and $R_2$ are each alkyl, halogenoalkyl or alkenyl each having at most 4 carbon atoms, and X is hydrogen or methyl, (b) 10 to 20 g of an alkanolamine of the formula

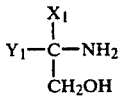

wherein $X_1$ is alkyl, hydroxyalkyl or halogenoalkyl each having 1 to 4 carbon atoms, or hydrogen, and $Y_1$ is alkyl, hydroxyalkyl or halogenoalkyl each having 1 to 4 carbon atoms, phenyl, benzyl, or cyclohexyl, with the alkanolamine being in the form of a watersoluble acid addition salt of inorganic acids, or aliphatic mono- or dicarboxylic acids having at most 4 carbon atoms, or of an alkanecarboxylic acid having 1 to 3 carbon atoms, and (c) 1 to 6 g of a water-soluble copper salt of an inorganic acid or of an alkanecarboxylic acid having 1 to 3 carbon atoms, and (d) 0 to 60 g of an aminoplast pre-condensate or an etherified aminoplast pre-condensate;

and thereupon drying the fiber material and subjecting it to a heat treatment at a temperature from 140° to 200° C.

2. Process according to claim 1, wherein there is used as component (a) a phosphorus compound of the formula

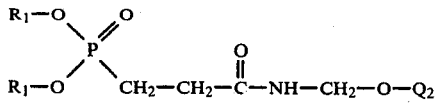

wherein $Q_2$ is hydrogen, ethyl, methyl or allyl, and $R_1$ has the meaning given in claim 1.

3. Process according to claim 2, wherein there is used as component (a) a phosphorus compound of the formula

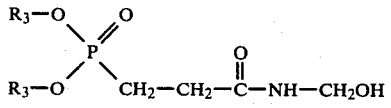

wherein $R_3$ is alkyl having 1 to 3 carbon atoms.

4. Process according to claim 1, wherein there is used as component (b) an alkanolamine of the formula

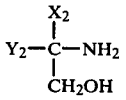

wherein $X_2$ is methyl, ethyl, propyl, hydroxyethyl or hydrogen, and $Y_2$ is methyl, ethyl, propyl, hydroxyethyl or phenyl, and the alkanolamine is in the form of an addition salt of hydrochloric, sulphuric, boric, sulphamic, acetic, chloroacetic, propionic, butyric, acrylic, maleic, benzoic, cinnamic or phthalic acid.

5. Process according to claim 1, wherein there is used as component (b) 2-amino-2-methyl-1-butanol, 2-amino-2-ethyl-1-butanol or 2-amino-2-methyl-1-propanol, which are in the form of addition salts of hydrochloric acid, phosphoric acid or sulphuric acid.

6. Process according to claim 1, wherein there is used as component (c) copper(II) acetate, copper(II) nitrate, copper(II) chloride or copper(II) sulphate.

7. Process according to claim 1, wherein there is used as component (d) a N-methylolurea or N-methylolmelamine or etherified N-methylolurea or N-methylolmelamine, which is etherified with an alkanol having 1 to 4 carbon atoms.

8. Process according to claim 1, wherein there is used as component (d) a dimethylolmelamine pre-condensate; a mixture of di- and trimethylolmelamine; or a mixture of pentamethylolmelaminedimethyl ether and pentamethylolmelaminetrimethyl ether.

9. Process according to claim 1, wherein the aqueous preparation have a pH of 5.0 to 7.5.

10. Process according to claim 1, which comprises applying to the textile fiber material said aqueous preparation by means of padding technique.

11. Dyed fiber material bearing thereon a fireproof finish obtained by the process according to claim 1.

12. Process according to claim 1, wherein is used said material dyes with azo dyes selected from the group consisting of the formulae,

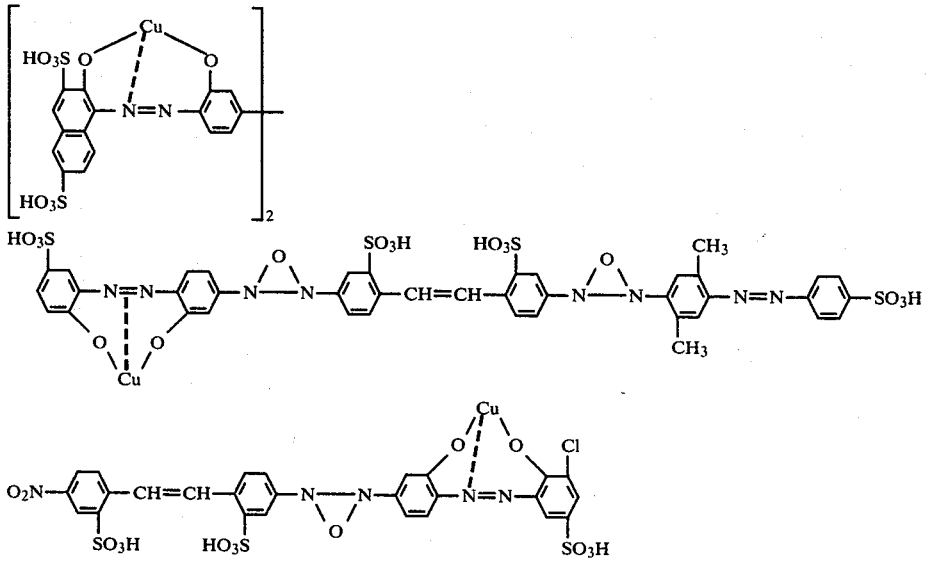

-continued
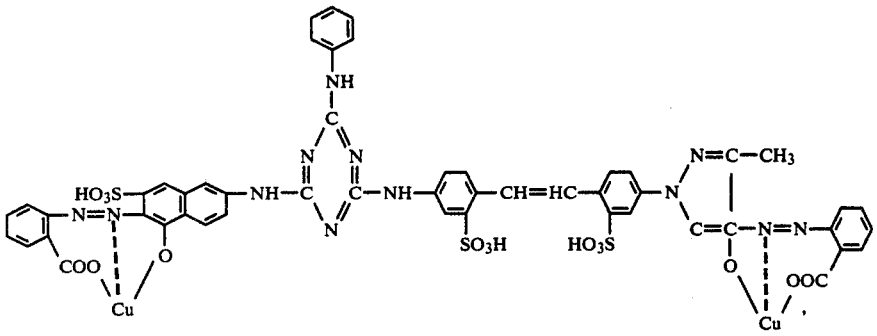
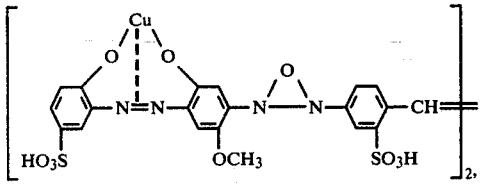
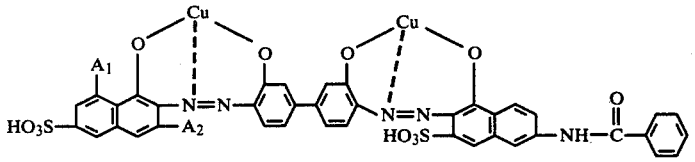
wherein
$A_1$ is —H, —$SO_3H$ or —OH and $A_2$ is —H or —$SO_3H$,
wherein $A_1$ is —H, —$SO_3H$ or —OH and $A_2$ is —H or —$SO_3H$,
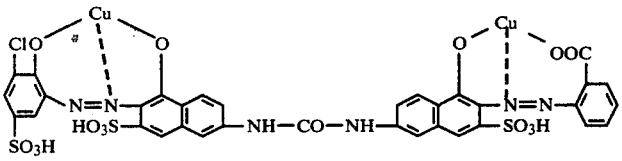
13. Process according to claim 1, wherein is used said material dyed with azo dyes selected from the group consisting of the formulae,
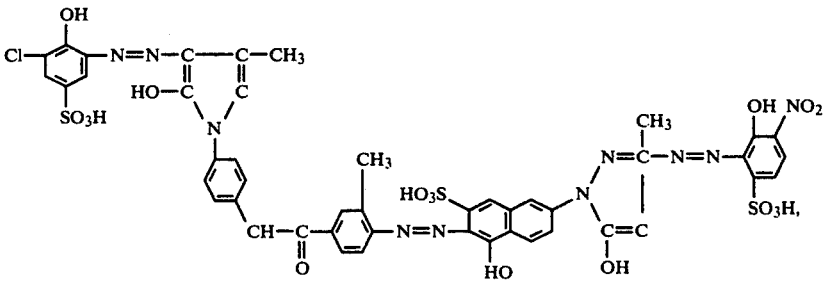
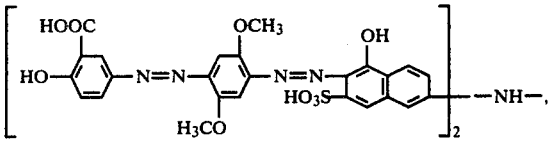
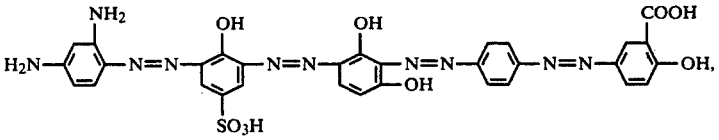

-continued
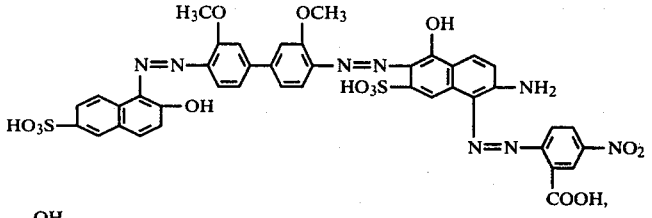
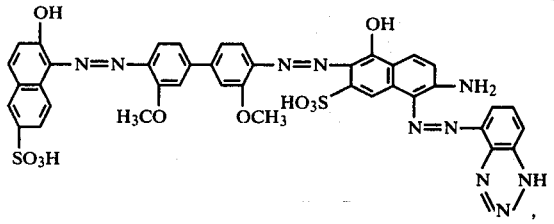
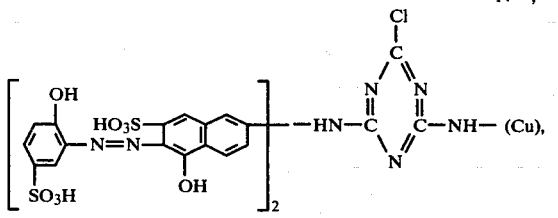
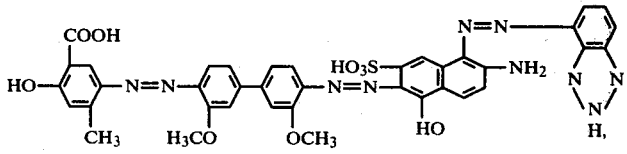
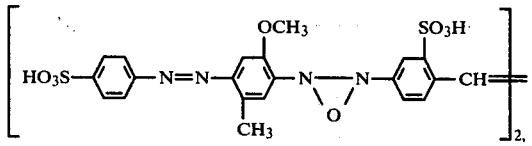
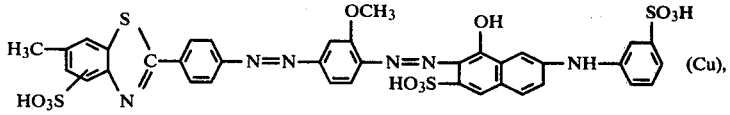
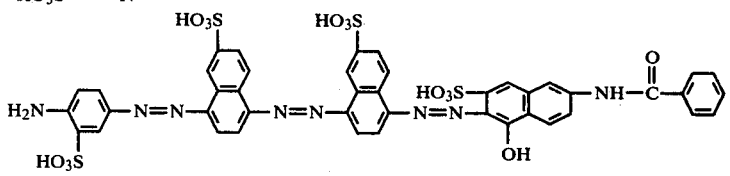
or
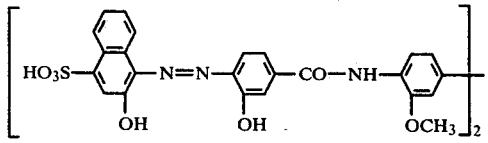
* * * * *